US007251427B2

(12) United States Patent
Nanataki et al.

(10) Patent No.: US 7,251,427 B2
(45) Date of Patent: Jul. 31, 2007

(54) HEATING APPARATUS

(75) Inventors: Hideo Nanataki, Kanagawa (JP); Taku Fukita, Shizuoka (JP); Yozo Hotta, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/776,380

(22) Filed: Feb. 12, 2004

(65) Prior Publication Data

US 2004/0161255 A1 Aug. 19, 2004

(30) Foreign Application Priority Data

Feb. 18, 2003 (JP) ..... 2003-039967

(51) Int. Cl.
*G03G 15/20* (2006.01)

(52) U.S. Cl. ..... 399/69; 219/216; 399/328

(58) Field of Classification Search ..... 399/251, 399/33, 69, 122, 280, 299
See application file for complete search history.

(56) References Cited

U.S. PATENT DOCUMENTS

| | | | | |
|---|---|---|---|---|
| 5,682,576 | A * | 10/1997 | Sakai et al. | 399/69 |
| 6,088,549 | A * | 7/2000 | Kagawa et al. | 399/67 |
| 6,411,785 | B1 * | 6/2002 | Ogawahara et al. | 399/69 |
| 6,701,102 | B2 * | 3/2004 | Hasegawa et al. | 399/69 |
| 6,985,689 | B2 * | 1/2006 | Nanataki et al. | 399/330 |
| 2003/0118363 | A1 * | 6/2003 | Izawa et al. | 399/69 |
| 2005/0074252 | A1 * | 4/2005 | Hirst et al. | 399/69 |

FOREIGN PATENT DOCUMENTS

| | | |
|---|---|---|
| JP | 9-190112 | 7/1997 |
| JP | 10-133505 | 5/1998 |
| JP | 10/232577 | 9/1998 |
| JP | 11194655 A * | 7/1999 |
| JP | 2002-251096 | 9/2002 |

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

The heating apparatus of a surface-heating type, includes a rotary member, an opposing member that forms a nip with respect to the rotary member, and a heating member for heating a portion of a rotary member surface other than the nip, in which temperature used for heating the rotary member by the heating member is controlled, and a heating material inserted in the nip to be nipped and conveyed therein is heated using heat of the rotary member. Accordingly, after insertion of the heating material in the nip starts, control temperature of the heating member is increased before the rotary member rotates by one revolution, thereby preventing an uneven heating phenomenon of the heating material in the first revolution and the second revolution or later, and preventing uneven gloss due to the uneven heating phenomenon in the fixing apparatus.

4 Claims, 14 Drawing Sheets

HEATING APPARATUS

BACKGROUND OF THE INVENTION

1. Field of the Invention

The present invention relates to a heating apparatus which is preferably used as a fixing apparatus of an image forming apparatus such as a copying machine or a printer. The fixing apparatus heats a recording material, on which a toner image made of a heat-softening resin is formed and carried, to form a permanently-fixed image on the recording material.

More particularly, the present invention relates to a heating apparatus of a type for heating a surface of a rotary member for heating the heating material (the material to be heated), the apparatus including: the rotary member for heating the heating material; an opposing member that forms a nip with respect to the rotary member; a heating member for heating a portion of a rotary member surface other than the nip; and temperature control means for controlling temperature used for heating the rotary member by the heating member, in which the heating material inserted in the nip to be nipped and conveyed therein using heat of the rotary member. The present invention also relates to an image forming apparatus including the heating apparatus as a fixing apparatus.

2. Related Background Art

For convenience, a description will be made taking as an example an image forming apparatus such as an electrophotographic copying machine, a printer, or a fax machine.

A fixing apparatus of an image forming apparatus is used for a process of heat-fixing an unfixed toner image to a surface of a recording material as a permanently-fixed image. The unfixed toner image is obtained in an image forming part of the image forming apparatus appropriately by means of an image forming process such as electrophotography, electrostatic recording, or magnetic recording. The unfixed toner image is formed on the surface of the recording material by using toner (a visualizing agent) composed of a heat-fusing resin or the like in a direct method or an indirect (transferring) method.

Up to now, examples of the fixing apparatus include a heating roller type and a film heating type.

The heating roller type employs a heating apparatus that heat-fixes an unfixed toner image to a surface of a recording material by including: a fixing roller (heating roller) and a pressure roller, which constitute a rotating roller pair; a heat source such as a halogen lamp built within the fixing roller so as to heat a portion to or control its temperature at a predetermined fixing temperature; and a press-contact nip portion (fixing nip portion) between the rotating roller pair through which the recording material as a heating material (a material to be heated), on which the unfixed toner image is formed and carried, is introduced, nipped, and conveyed.

The film heating type employs a heating apparatus that includes: a film having a small heat capacity instead of the heating roller so as to nip and convey a recording material between the film and the pressure roller; and a heater disposed to an inner surface of the film so as to heat the recording material. The film heating type increases the temperature for a short period of time, and is thus utilized as an on-demand fixing apparatus that can increase the temperature to a temperature for fixing, upon demand for heating to fix an image, immediately after starting the heating.

On the other hand, if the fixing roller or the film is coated with a resilient layer made of rubber or the like, the resilient layer functions as a heat insulating layer against the heating from the inside. Therefore, it takes longer even for the film heating type to increase the temperature, making it difficult to secure on-demand fixing.

In the case of coating a surface of a rotary member for heating a recording material as a heating material with a resilient layer, a releasing layer, or the like having heat insulating property, there is proposed an apparatus of a surface-heating type in which heat is supplied from a surface side of the rotary member (refer to, for example, Japanese Patent Application Laid-Open No. H10-133505). According to the apparatus of the surface-heating type, heat can be supplied from the surface of the rotary member for heating, improving responsiveness to power supply to a heater as a heating source. Even in the case of using the rotary member coated with the resilient layer, it is possible to reduce rising time.

However, in the apparatus of the surface-heating type, the rotary member has a temperature gradient that decreases from its surface to its deep part. Thus, even if the surface of the rotary member is deprived of heat due to insertion of the recording material as a heating material, there is little heat to be supplied from the inside of the rotary member. As a result, the amount of heat to be supplied to the recording material from the rotary member having a large amount of stored heat in the first revolution is different from that in the second revolution or later, causing a problem in that an uneven gloss (gloss non-uniformity) occurs due to uneven heating.

The above-mentioned circumstances have created a demand for a fixing apparatus with reduced rising time and without an image defect such as an uneven gloss occurring due to uneven heating.

SUMMARY OF THE INVENTION

The present invention is therefore to provide a fixing apparatus of a surface-heating type which can meet the above-mentioned demand.

According to the present invention, there is provided a heating apparatus for heating a heating material inserted in a nip to be hipped and conveyed therein using heat of a rotary member, including:

the rotary member;

an opposing member that forms the nip with respect to the rotary member;

a heating member for heating a portion of a rotary member surface other than the nip; and temperature control means for controlling temperature used for heating the rotary member by the heating member, in which after insertion of the heating material in the nip starts, the temperature control means increases temperature of the heating member before the rotary member rotates by one revolution.

As for the rotary member that receives heat supply of a surface-heating type by the heating member in a portion of the rotary member surface other than the nip for heating the inserted heating material, after the insertion of the heating material in the nip starts, the control temperature of the heating member for heating the rotary member is increased before the rotary member rotates by one revolution. Accordingly, heat supplying capacity of the rotary member with respect to the heating material can be maintained constant.

It is preferable that the temperature control means decrease the control temperature of the heating member before discharging of the heating material from the nip completes.

The control temperature of the heating member is decreased before the discharging of the heating material from the nip is completed, that is, the control temperature of the heating member is recovered before discharging the heating material. Accordingly, while the heating material is not inserted, the temperature of the rotary member can be prevented from increasing.

According to the above-mentioned actions, there can be provided an image forming apparatus in which image non-uniformity such as uneven gloss is not generated even if the heating apparatus is used as an energy-saving fixing apparatus with shorter rising time.

It is preferable that after the insertion of the heating material in the nip starts, the temperature control means increases the control temperature of the heating member within L/V, where L is assumed as a distance from the nip to the portion of the rotary member surface to be heated by the heating member along a rotating direction of the rotary member, and V is assumed as tangential speed for rotation of the rotary member.

The heating apparatus is preferably a heating apparatus for heating a heating material inserted in a nip to be nipped and conveyed therein using heat of a rotary member, including:

the rotary member;

an opposing member that forms the nip with respect to the rotary member;

a heating member for heating a portion of a rotary member surface other than the nip; and temperature control means for controlling temperature used for heating the rotary member by the heating member, in which after insertion of the heating material in the nip starts, the temperature control means increases power supplied to the heating member before the rotary member rotates by one revolution.

It is preferable that the temperature control means decreases the power supplied to the heating member before discharging of the heating material from the nip is completed.

It is preferable that after the insertion of the heating material in the nip starts, the temperature control means increases the power supplied to the heating member within L/V, where L is assumed as a distance from the nip to the portion of the rotary member surface to be heated by the heating member along a rotating direction of the rotary member, and V is assumed as tangential speed for rotation of the rotary member.

It is preferable that the heating member heat the rotary member surface through a film, and that the temperature control means includes temperature detecting means that is in contact with a film surface opposite to a film surface contacting the rotary member in a portion in which the film contacts the rotary member surface.

The temperature detecting means is preferably disposed in the portion in which the film contacts the rotary member surface on an upstream side in a rotary member rotating direction.

The temperature detecting means is disposed in the portion in which the film contacts the rotary member surface on a downstream side in the rotary member rotating direction.

It is preferable that heating member includes a ceramic heater as a heating source, and that the temperature detecting means of the temperature control means be disposed to a back surface of the ceramic heater.

The opposing member is preferably a rotary member.

The heating material is preferably a recording material bearing an image.

In an image forming apparatus including image forming means for forming an unfixed toner image on a recording material so as to be borne thereon and fixing means for heat-fixing the unfixed toner image on the recording material to the recording material, it is preferable that the heating apparatus is used as the fixing means.

DESCRIPTION OF THE PREFERRED EMBODIMENTS

Embodiment 1; FIGS. 1 to 6, 11 and 12

(1) Example of Image Forming Apparatus

Figure 2:
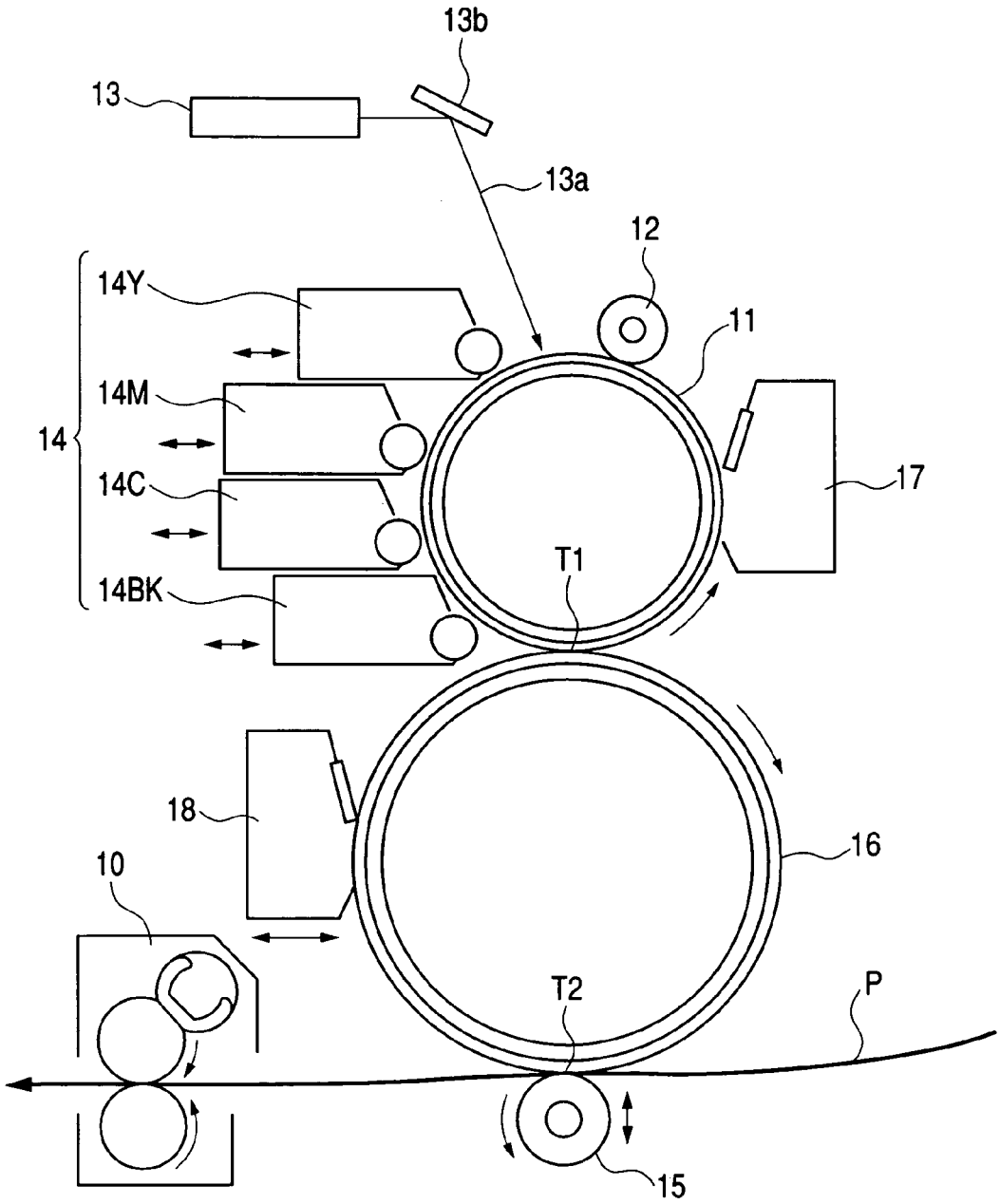
FIG. 2 is a structural diagram showing an outline of an image forming apparatus according to Embodiment 1.

FIG. 2 is a structural diagram showing an outline of an example of an image forming apparatus. As the image forming apparatus of this embodiment, a full-color electrophotographic printer is used, which is an apparatus using a center reference for passing paper with the widthwise center of a recording material aligned with the lengthwise center of the image forming apparatus.

The image forming apparatus includes a photosensitive drum (image bearing member) 11 of an electrophotographic process which is composed of an organic photosensitive member. The photosensitive drum (image bearing member)

11 is driven to rotate counterclockwise as indicated by an arrow at a predetermined process speed (peripheral speed) V (=120 mm/sec).

During the rotation drive process, the photosensitive drum 11 is uniformly charged to a predetermined polarity and potential by a charging device 12 such as a charging roller.

The charged surface of the photosensitive drum 11 of an electrophotographic type then undergoes scanning and exposure based on target image information by laser light 13*a* outputted from a laser optical box (laser scanner) 13. The laser optical box 13 outputs the laser light 13*a* modulated (turned on or off) corresponding to time series electrical digital pixel signals of the target image information from an image signal generating apparatus (not shown) such as a computer, and subjects a photosensitive drum surface to scanning and exposure. As a result of the scanning and exposure, an electrostatic latent image corresponding to the target image information used for the scanning and exposure is formed on the photosensitive drum 11 surface. The image forming apparatus also includes a mirror 13*b* for reflecting the laser light 13*a* outputted from the laser optical box 13 to an exposure position on the photosensitive drum 11.

In the case of forming a full-color image, the scanning and exposure and the forming of a latent image are performed on a first color separation component image, for example, a yellow component image, of a target full-color image, and the latent image is developed as a yellow toner image by the action of a yellow developing device 14Y among four-color developing devices 14. The yellow toner image is transferred onto a surface of an intermediate transfer drum 16 at a primary transfer portion T1 that is a contact portion (or proximate portion) between the photosensitive drum 11 and the intermediate transfer drum 16. The photosensitive drum 11 surface that has undergone the transfer of the toner image onto the intermediate transfer drum 16 surface is cleaned by a cleaner 17 that removes adhesion residuals such as untransferred toner therefrom.

The above-described process cycle including charging, scanning and exposure, development, primary transfer, and cleaning is sequentially executed for respective color separation component images of the target full-color image, that is, a second color separation component image (for example, magenta component image by the action of a magenta developing device 14M), a third color separation component image (for example, cyan component image by the action of a cyan developing device 14C), and a fourth color separation component image (for example, black component image by the action of a black developing device 14BK). Then, four-color toner images in total, that is, the yellow toner image, a magenta toner image, a cyan toner image, and a black toner image, are sequentially transferred onto the intermediate transfer drum 16 surface. Thus, the four-color toner images are composited to form a color image corresponding to the target full-color image.

The intermediate transfer drum 16 has a medium-resistivity resilient layer and a high-resistivity surface layer on a metal drum. The intermediate transfer drum 16 is driven to rotate clockwise as indicated by an arrow at approximately the same peripheral speed as the photosensitive drum 11 while being in contact with or proximate to the photosensitive drum 11. The metal drum is applied with a bias potential to produce a potential difference with respect to the photosensitive drum 11 so as to transfer the toner image on the photosensitive drum 11 side onto the intermediate transfer drum 16 surface side.

In a secondary transfer portion T2 that is a contact nip between the intermediate transfer drum 16 and a transfer roller 15, the composite color toner image on the intermediate transfer drum 16 surface is transferred onto a recording material P that has been sent out to the secondary transfer portion T2 from a paper feeding part (not shown) at a predetermined timing. The transfer roller 15 supplies charges having the polarity opposite to the toner from a back surface of the recording material P to thereby collectively transfer the composite color toner image onto the recording material P side from the intermediate transfer drum 16 surface side continuously.

The recording material P that has passed the secondary transfer portion T2 is separated from the intermediate transfer drum 16 surface, is introduced to a fixing apparatus 10, has an unfixed toner image heat-fixed, and is discharged to a discharge tray (not shown) outside the image forming apparatus as a material formed with a color image.

Used as the fixing apparatus 10 is a heating apparatus according to the present invention. The fixing apparatus 10 will be described in detail in the next section (2).

The intermediate transfer drum 16 that has undergone the transfer of the color toner image onto the recording material P is cleaned by a cleaner 18 that removes adhesion residuals such as untransferred toner and paper powder therefrom. The cleaner 18 is normally held without contact with the intermediate transfer drum 16. While the color toner image is being secondarily transferred from the intermediate transfer drum 16 onto the recording material P, the cleaner 18 is held in contact with the intermediate transfer drum 16.

Meanwhile, before an image is formed in black (BK) as the fourth color, the transfer roller 15 is also held without contact with the intermediate transfer drum 16. While the color toner image is being secondarily transferred from the intermediate transfer drum 16 onto the recording material P, the transfer roller 15 is held in contact with the intermediate transfer drum 16.

Figure 11:
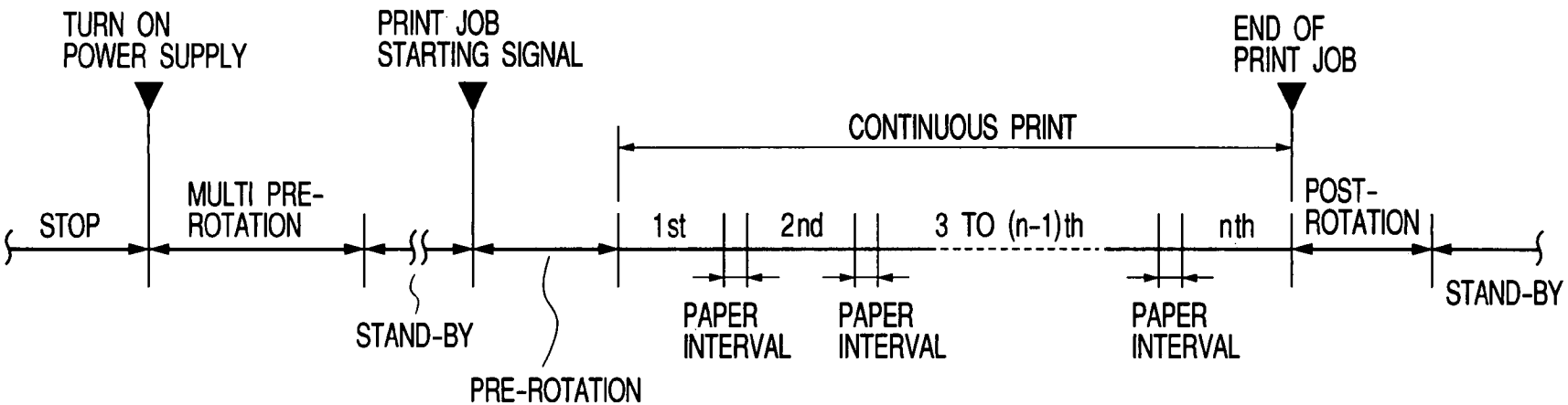
FIG. 11 is an operation bar chart of an image forming apparatus.

Compared to such a full-color image forming operation, during mono-color image forming operation, only the black developing device 14BK is operated without switching the developing devices. The next page image can be continuously formed on the intermediate transfer drum 16, and a series of image forming operations are performed while the transfer roller 15 and the cleaner 18 is in abutment with the intermediate transfer drum 16. Therefore, an image can be formed in the mono-color image forming about four times as fast as in the full-color image forming. The recording speed according to this embodiment is 4 pages (A4 size) per minute in the full-color image forming and 16 pages per minute in the mono-color image forming. By repeating the above operation, the image forming can be continuously performed. FIG. 11 is an operation bar chart of the image forming apparatus.

A) Multi-pre-rotation Step

A multi-pre-rotation step corresponds to a starting (activating) operation period (warming period) for the image forming apparatus. By turning on a main power switch of the image forming apparatus, a main motor of the image forming apparatus is activated to execute preparation operations for the necessary process devices.

B) Stand-by

After the predetermined starting operation period ends, drive of the main motor stops, and the image forming apparatus maintains a stand-by status until an input of a print job starting signal.

C) Pre-rotation Step

A pre-rotation step, which corresponds to a period during which the main motor is driven again in response to the input of a print job starting signal and print job pre-operations for the necessary process devices, is executed.

More practically, the procedure is as follows in the stated order: (a) the image forming apparatus receives the print job starting signal, (b) a formatter expands an image (expansion time varies depending on the amount of image data or the process speed of the formatter), and (c) the pre-rotation step starts.

Note that in the case where the print job starting signal is inputted in the multi-pre-rotation step of the above paragraph A, the multi-pre-rotation step is followed by the pre-rotation step, skipping the stand-by of the above paragraph B.

D) Execution of Print Job

After the predetermined multi-pre-rotation step ends, the image forming process is subsequently executed and the image-formed recording material is outputted.

In the case of continuous print jobs, the image forming process is repeated, thereby outputting a predetermined number of sheets of the image-formed recording materials sequentially.

E) Paper Interval Step

In the case of continuous print jobs, a paper interval step is a step for the interval between a trailing edge of a recording material P and a leading edge of the next recording material P, and corresponds to a period during which paper is not passing a transfer part or the fixing apparatus.

F) Post-rotation Step

A post-rotation step corresponds to a period for executing print job post-operation for the necessary process devices by continuously driving the main motor even after outputting the image-formed recording material (end of print job) in the case of a print job for only one sheet, or even after outputting the last image-formed recording material for continuous print jobs (end of print job) in the case of the continuous print jobs.

G) Stand-by

After the predetermined post-rotation step ends, drive of the main motor stops, and the image forming apparatus maintains a stand-by (waiting) status until an input of the next print job starting signal.

(2) Fixing Apparatus 10

Figure 1:
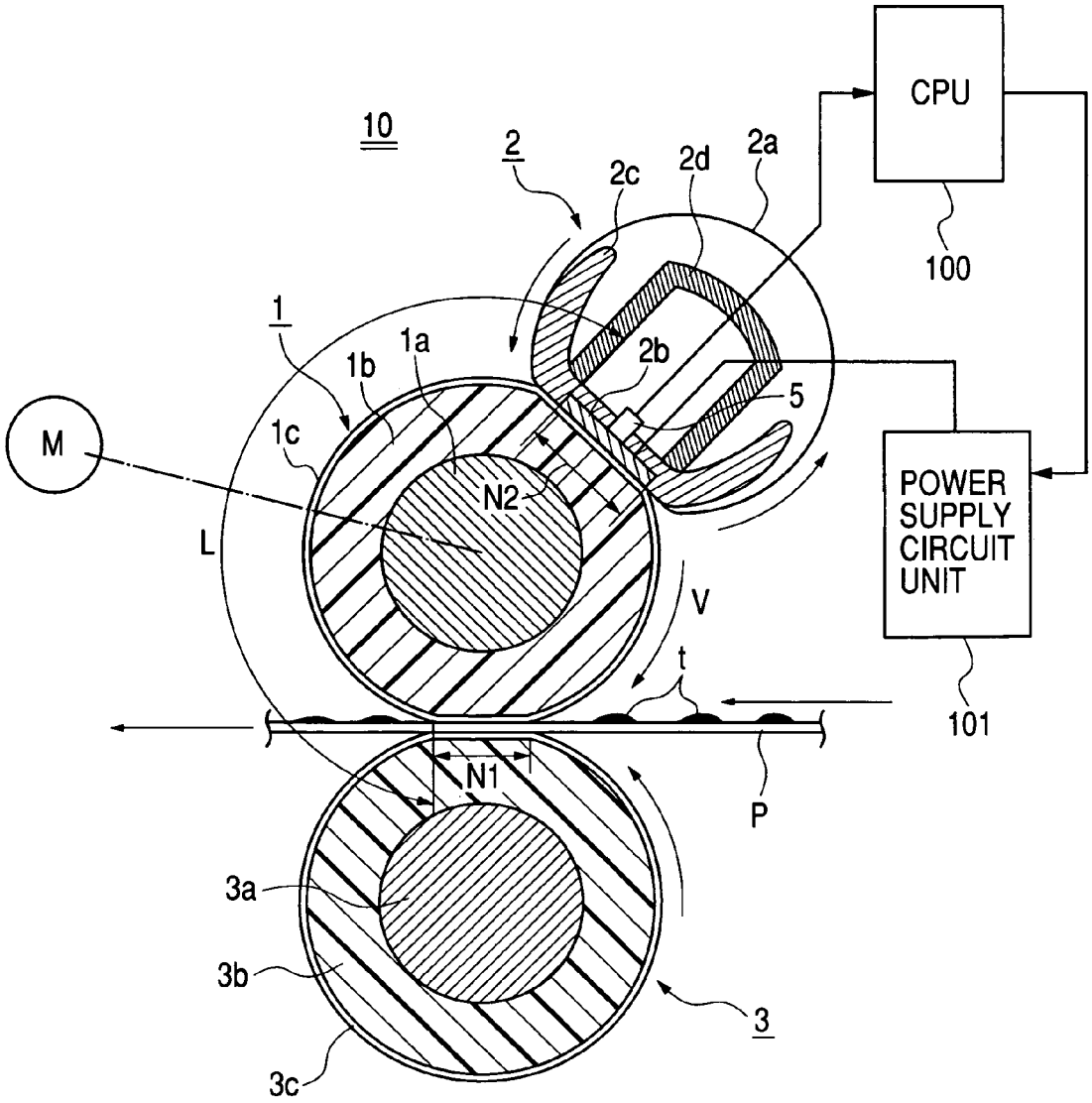
FIG. 1 is a cross-sectional schematic diagram of a fixing apparatus according to Embodiment 1.

FIG. 1 is a cross-sectional schematic diagram of the fixing apparatus 10. The fixing apparatus 10 is a heating apparatus of a surface-heating type according to the present invention. The fixing apparatus 10 includes: a fixing roller 1 as a rotary member for heating the recording material P as a heating material; a pressure roller 3 as an opposing member that forms a fixing nip N1 with respect to the fixing roller 1; a surface-heating unit 2 as a heating member for heating a surface of the fixing roller 1; and temperature control means for controlling temperature used for heating the fixing roller 1 by the surface-heating unit 2, and is composed of a thermistor 5, a control circuit (CPU) 100, and a power supply circuit (power supply circuit unit) 101.

The fixing roller 1 is a resilient roller with an outer diameter of 20 mm composed of a core metal 1*a*, a silicone rubber layer 1*b* with a thickness of 3 mm which coats an outer periphery of the core metal 1*a*, and a PFA resin 1*c* with a thickness of 50 μm which coats an outer periphery of the silicone rubber layer 1*b*.

Similarly, the pressure roller 3 is a resilient roller with an outer diameter of 20 mm composed of a core metal 3*a*, a silicone rubber layer 3*b* with a thickness of 3 mm which coats an outer periphery of the core metal 3*a*, and a PFA resin 3*c* with a thickness of 50 μm which coats an outer periphery of the silicone rubber layer 3*b*. The pressure roller 3 is pressed onto the fixing roller 1 at a predetermined applied pressure (100 N) to form the fixing nip N1 as a nip portion for a heating material.

The surface-heating unit 2 includes a ceramic heater 2*b* as heating means (heating source), a heater holder 2*c* that supports the ceramic heater 2*b*, a heating film 2*a* of an endless belt shape (cylindrical shape) externally fitted rotatably around the heater holder 2*c*, and a pressure stay 2*d*. The pressure stay 2*d* presses the heater holder 2*c* onto the fixing roller 1 against resilience of the silicone rubber layer 1*b*, and brings the ceramic heater 2*b* into press contact with the fixing roller 1 through the heating film 2*a*, thereby forming a heating nip N2.

The heating film 2*a* has a peripheral length of 56.5 mm and is obtained by coating a surface of a polyimide (PI) resin of 40 μm in thickness with a PFA resin of 10 μm in thickness. The ceramic heater 2*b* has an output of 700 W and is obtained by printing a resister on alumina of 8 mm in width and 1 mm in thickness, the resister being protected by glass from above.

The fixing roller 1 is driven to rotate clockwise as indicated by an arrow of FIG. 1 by driving means M. Simultaneously with the rotation drive of the fixing roller 1, the pressure roller 3 is rotated counterclockwise as indicated by an arrow due to friction within the fixing nip N1. At the same time, the heating film 2*a* of the surface-heating unit 2 is rotated around an outer periphery of the heater holder 2*c* counterclockwise as indicated by an arrow due to friction within the heating nip N2 while an inner side of the heating film 2*a* slides in close contact with a surface of the ceramic heater 2*b*.

The ceramic heater 2*b* as the heating means of the surface-heating unit 2 increases temperature rapidly by allowing power supply to an electrical-heat-generation resistive layer from the power supply circuit 101. The heat generation from the ceramic heater 2*b* causes the surface of rotating fixing roller 1 to be heated through the heating film 2*a* in the heating nip N2.

In this embodiment, the thermistor 5 as temperature detecting means is abutted against a back surface of the ceramic heater 2*b*. Based on a temperature detected by the thermistor 5, the control circuit 100 as the temperature control means controls a state where power is supplied from the power supply circuit 101 to the ceramic heater 2*b* to control temperature so as to maintain the surface temperature of the fixing roller 1 at a predetermined fixing temperature.

In a state where: the fixing roller 1 is driven to rotate; the pressure roller 3 and the heating film 2*a* of the surface-heating unit 2 are rotated; and power is supplied to the ceramic heater 2*b* of the surface-heating unit 2 to heat and control the surface temperature of the fixing roller 1 to reach and stay at a predetermined fixing temperature, a recording material P bearing an unfixed toner image t as a heating material is introduced into the fixing nip N1 between the fixing roller 1 and the pressure roller 3. Then, the recording material P passes the fixing nip N1 along with the fixing roller 1 in close contact with an outer surface of the fixing roller 1. While passing the fixing nip N1, the toner image t is heated by heat conduction from the fixing roller 1, thereby being subjected to heat-fixing of toner image. The recording material P that has passed the fixing nip N1 is separated from the outer surface of the fixing roller 1 on a recording material exit side, and further conveyed.

(3) Temperature Control

According to this embodiment, heat is supplied to the fixing roller 1 surface from the surface-heating unit 2, and the recording material P is heated by the heat supplied to the fixing roller 1. In order to follow up a change in the temperature of the fixing roller 1 surface and have the temperature converge on a target temperature rapidly, the control circuit (CPU) 100 controls the state where the power is supplied to the ceramic heater 2*b* by PID control (determining the next state by proportional/integral/derivative processes based on a change in past temperature over the elapse of time).

Figure 3:
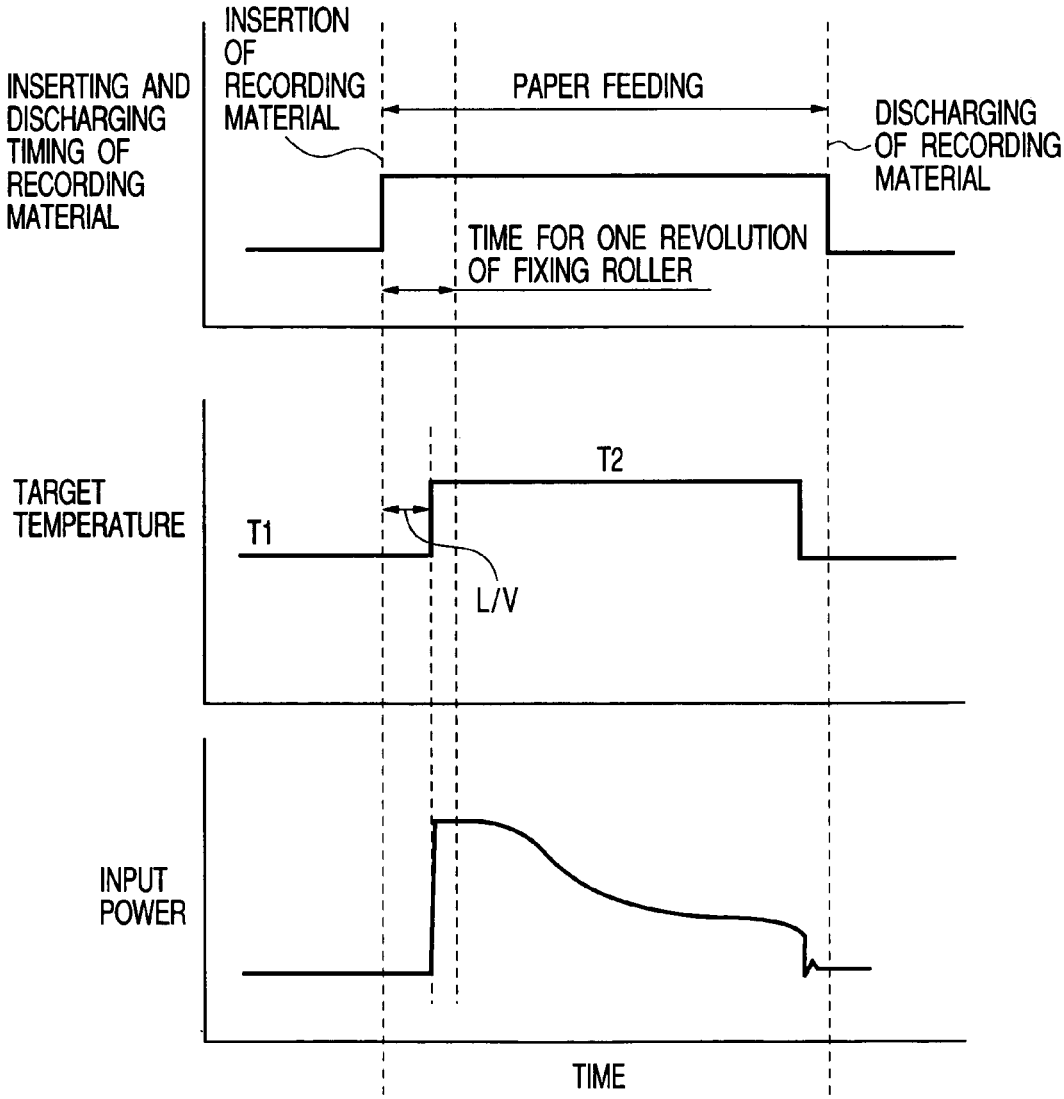
FIG. 3 is a diagram showing control according to Embodiment 1.

FIG. 3 shows the control according to this embodiment over the elapse of time, and indicates the target temperature and the power that is inputted to the ceramic heater 2*b* with the insertion of the recording material P in the fixing nip N1 set as a starting point.

In this embodiment, in order to maintain constant the heat supplying capacity of the fixing roller 1 with respect to the recording material P, the target temperature is set at T1=200° C. in the first revolution, and changed to T2=250° C. in the second revolution. The ceramic heater 2*b* and the heating film 2*a* according to this embodiment have an extremely small heat capacity, allowing an instantaneous increase in temperature of the heating film 2*a* (with a stand-by temperature increase rate of approximately 80° C./sec). Therefore, the target temperature may be switched from T1 to T2 when a time s1 (=L/V) elapsed after the insertion of the recording material P in the fixing roller 1. The time s1 is a time required for the fixing roller 1 to rotate by a distance (L=40 mm) from the fixing nip N1 to the heating nip N2.

Figure 12:
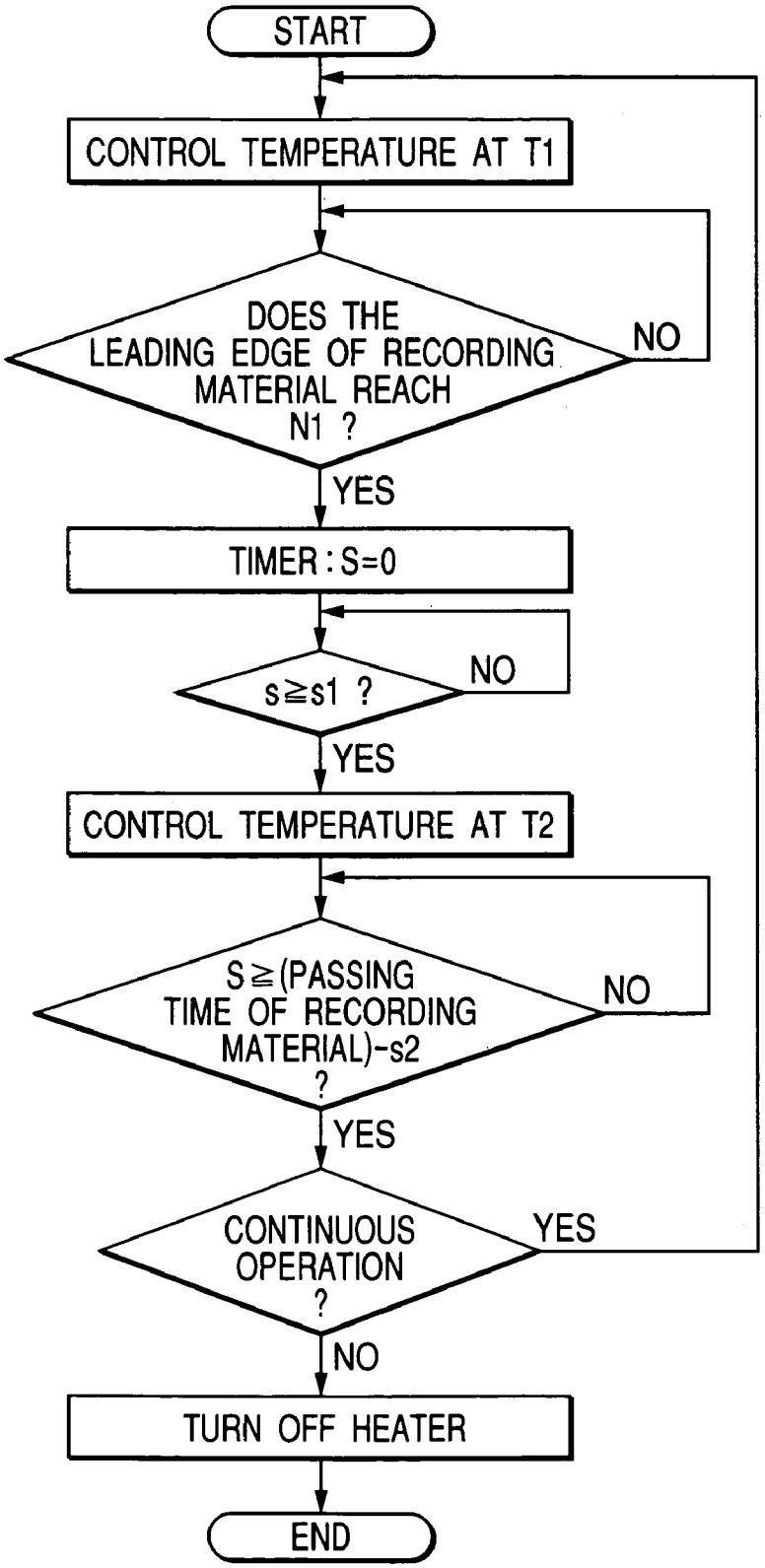
FIG. 12 is a diagram showing a control flow of the image forming apparatus according to Embodiment 1.

Hereinbelow, a description is made of operation of this embodiment along a flowchart of FIG. 12.

A) At the start of printing, power supply to the ceramic heater 2*b* starts, and the temperature is controlled at the target temperature T1 based on the temperature detected by the thermistor 5.

B) A timer s is initialized at the time point when the recording material P reaches the fixing nip N1, and the target temperature is switched over to T2 at the timing when the time s1 elapsed.

C) In the case of a continuous printing operation, to prepare for the next recording material, the target temperature is switched from T2 back to T1 a time s2 before the timing when the recording material P is discharged from the fixing nip N1. The time s2 is a time required for the fixing roller 1 to rotate by a distance from the heating nip N2 to the fixing nip N1. The operation prevents the fixing roller 1 from being overheated during the paper interval step.

D) At the end of printing, power supply to a heater is turned off.

Note that the control circuit 100 performs the temperature control of FIG. 3 over the elapse of time by calculating the time point when a fed recording material P reaches the fixing nip N1 and is about to be inserted therein and the time point when the recording material P is discharged from the fixing nip N1 based on information including the time point when the recording material P is fed, the time point when the recording material P is timing-fed by a registration roller, the conveying speed of the recording material P, and the recording material size thereof.

(4) Comparative Example

Figure 4A:
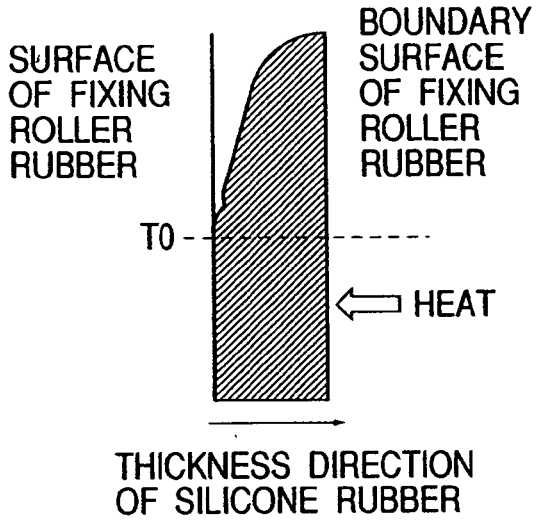
FIG. 4A PRIOR ART
FIG. 4A is a model diagram showing a temperature distribution within a silicone rubber layer of a type that is heated from an inside of a fixing roller according to a conventional example.
Figure 4B:
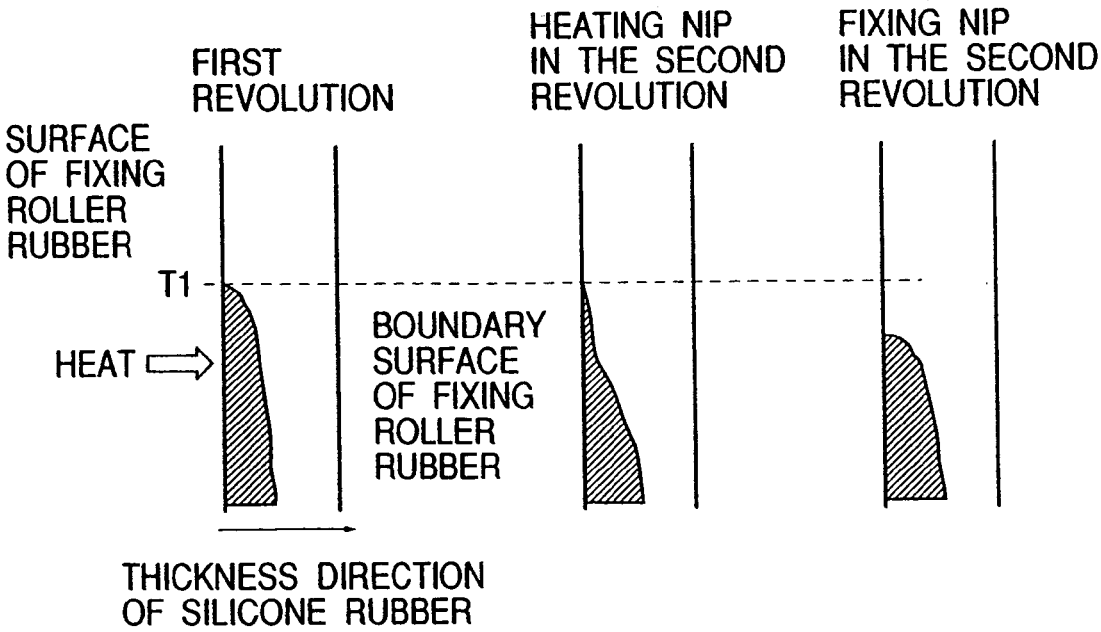
FIG. 4B PRIOR ART
FIG. 4B is a model diagram showing a change in a temperature distribution within a silicone rubber layer 1*b* in the case of inserting a recording material P in a fixing nip N1.
Figure 4C:
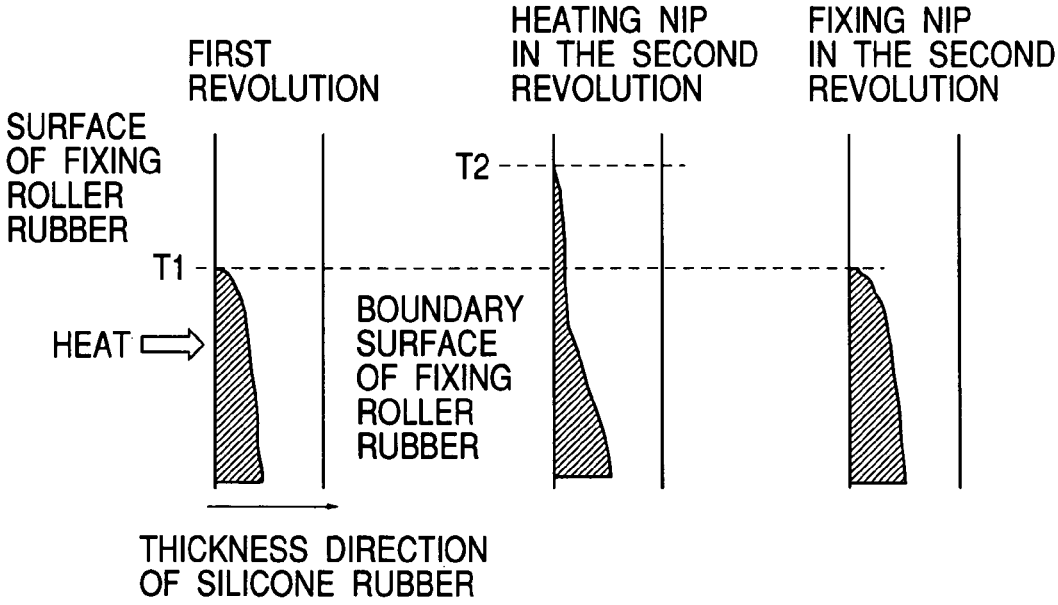
FIG. 4C is a model diagram showing a change in the temperature distribution within the silicone rubber layer 1*b* in the case of performing the above-mentioned control, which exhibits characteristics of this embodiment.

FIGS. 4A to 4C are model diagrams for explaining the phenomena caused in this embodiment. FIG. 4A shows a temperature distribution within a silicone rubber layer of a type that is heated from an inside of a fixing roller according to a conventional example. In order to obtain a temperature T0 in a surface of the fixing roller (outside of rubber), a deep part of the rubber layer is maintained at a high temperature. It requires a large amount of heat to reach such a state. Thus, it takes long to reach the temperature capable of fixing. Meanwhile, after heat is supplied to a recording material from the surface of the fixing roller, heat is constantly supplied from a high temperature region in the deep part. The state in the second revolution can be maintained similarly to that in the first revolution.

FIG. 4B shows the case of a comparative example in which a fixing apparatus of a surface-heating type is used to maintain the surface of the fixing roller 1 at a constant temperature T1 (180° C.). FIG. 4B also shows a change in a temperature distribution within the silicone rubber layer 1*b* in the case of inserting the recording material P in the fixing nip N1.

During the first revolution of the fixing roller 1 after the insertion of the recording material P, heat is stored not only in the surface of the fixing roller 1 but also in its deep part and in the vicinity of its surface due to the heating before the insertion of the recording material P (during the paper interval step or the pre-rotation step), providing the fixing roller 1 with a high heat supplying capacity. On the other hand, within the heating nip N2 in the second revolution or later, only the vicinity of the surface of the fixing roller 1 is heated, increasing its temperature. However, in the fixing nip N1, the fixing roller 1 undergoes thermal relaxation (a phenomenon that temperature is equalized due to thermal diffusion), and its actual temperature is low. Thus, the heat supplying capacity of the fixing roller 1 can be assumed to be lowered.

Figure 5:
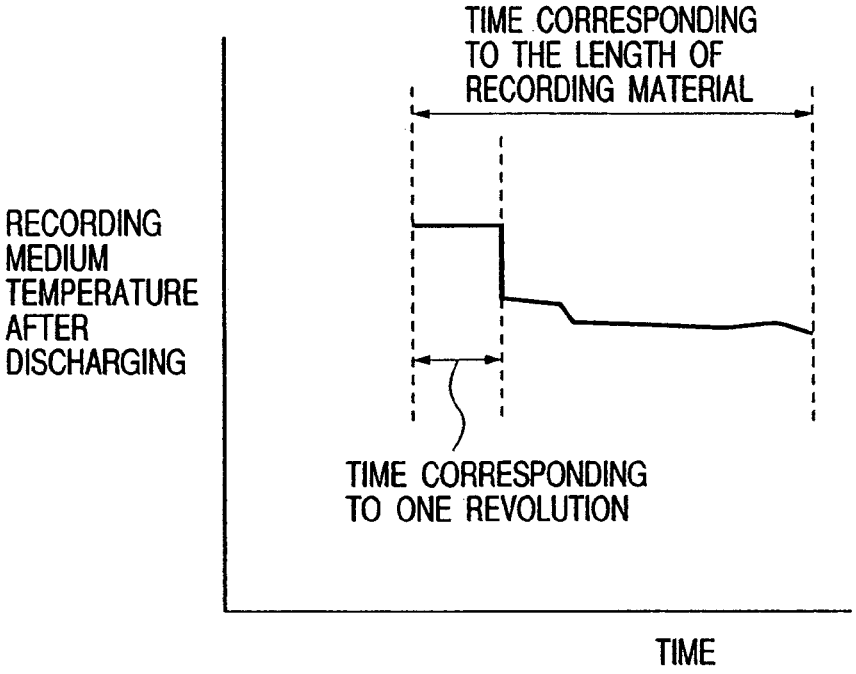
FIG. 5 PRIOR ART
FIG. 5 is a diagram showing a recording material temperature after discharging according to a comparative example.

In such conditions, it is observed as shown in FIG. 5 that the temperature of the discharged recording material P decreases stepwise between the time corresponding to the first revolution and the time corresponding to the second revolution or later.

FIG. 4C is a model diagram showing a change in the temperature distribution within the silicone rubber layer 1*b* in the case of performing the temperature control, which exhibits characteristics of this embodiment.

In this embodiment, the temperature control is performed to change the surface temperature of the fixing roller 1 from T1 in the first revolution with a large amount of stored heat to T2 in the second revolution or later with a small amount of stored heat, so that the temperature distribution state after the thermal relaxation in the first revolution becomes the same as that in the second revolution or later. Thus, the heat supplying capacity is maintained uniform.

Figure 6:
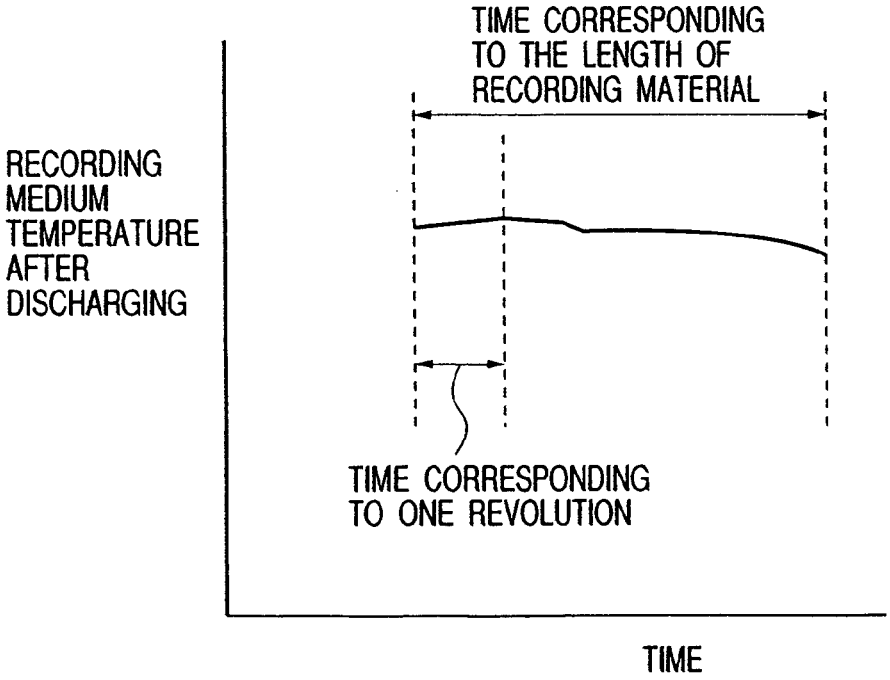
FIG. 6 is a diagram showing a recording material temperature after discharging according to Embodiment 1.

Accordingly, power is supplied to the ceramic heater 2*b* to control the temperature of the discharged recording material P so as to be almost constant (at 90° C.) as shown in FIG. 6. Measurement was performed on image glosses on recording materials outputted from the image forming apparatus according to the comparative example relating to the change in the temperature distribution of FIG. 4B and the image forming apparatus according to this embodiment, resulting in Table 1.

TABLE 1

| | | Gloss | |
|---|---|---|---|
| | Toner amount | First revolution | Second revolution |
| Comparative | Bk mono-color | 15 | 7 |
| Example | 2 colors (M + C) | 25 | 10 |
| This | Bk mono-color | 15 | 15 |
| embodiment | 2 colors (M + C) | 25 | 25 |

In the fixing apparatus developing the stepwise temperature change such as in the comparative example, a large gloss change is observed at the turn of the temperature change between the first revolution and the second revolution. On the contrary, it is apparent that the gloss change is suppressed by the temperature control of this embodiment.

Note that in this embodiment, a film heating type that is high in temperature increase rate is shown as an example. In the case of using the heating means having a large heat capacity which requires time for a temperature increase, the same effects as this embodiment can be obtained by switching over the target temperature earlier by the time required for the temperature increase.

Further, power supplied to the ceramic heater 2*b* is changed between the first revolution and the second revolution or later to achieve the uniform heat supplying capacity of the fixing roller 1, producing the same effects.

Figure 7:
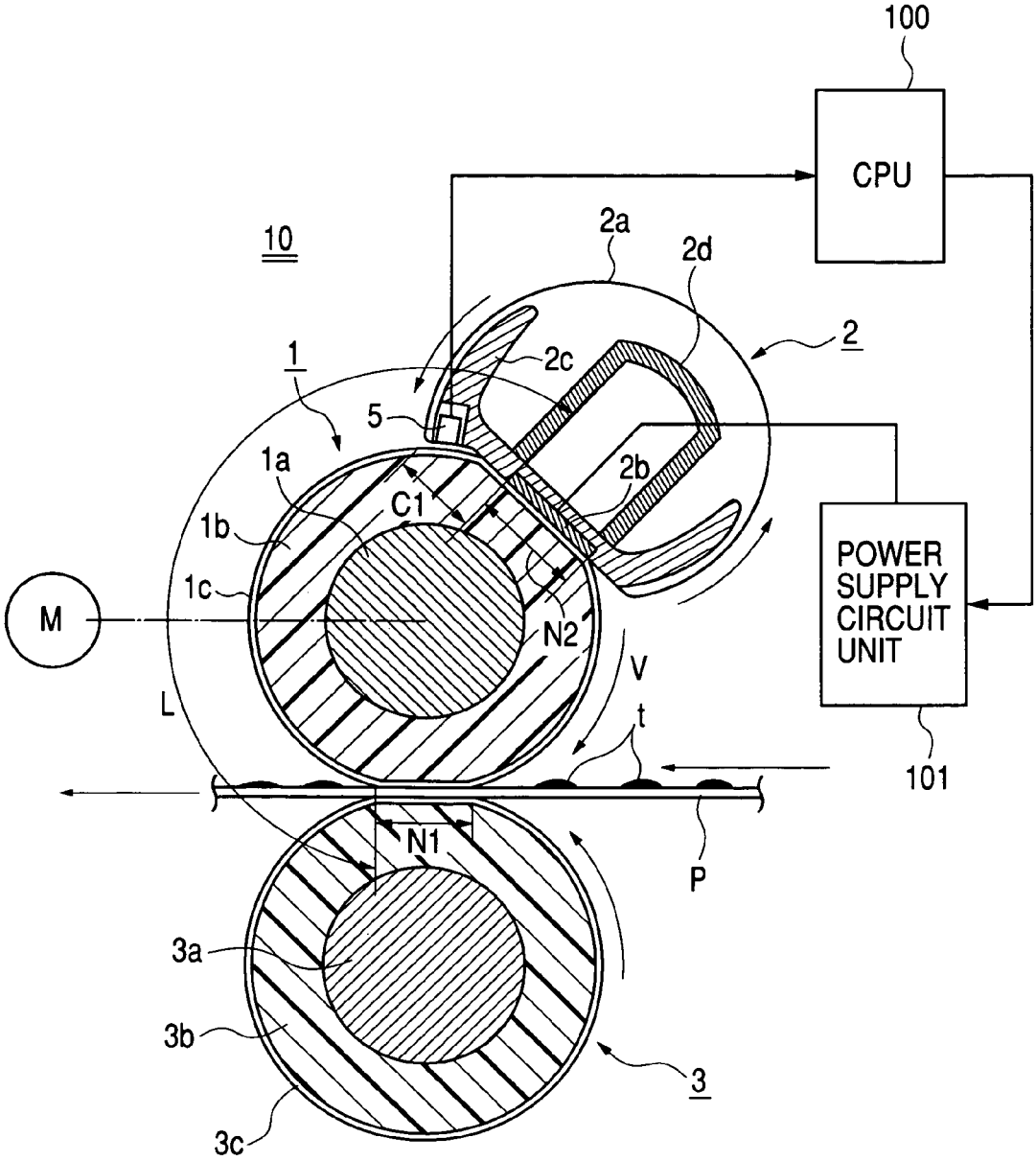
FIG. 7 is a cross-sectional schematic diagram of a fixing apparatus according to Embodiment 2.
Figure 8:
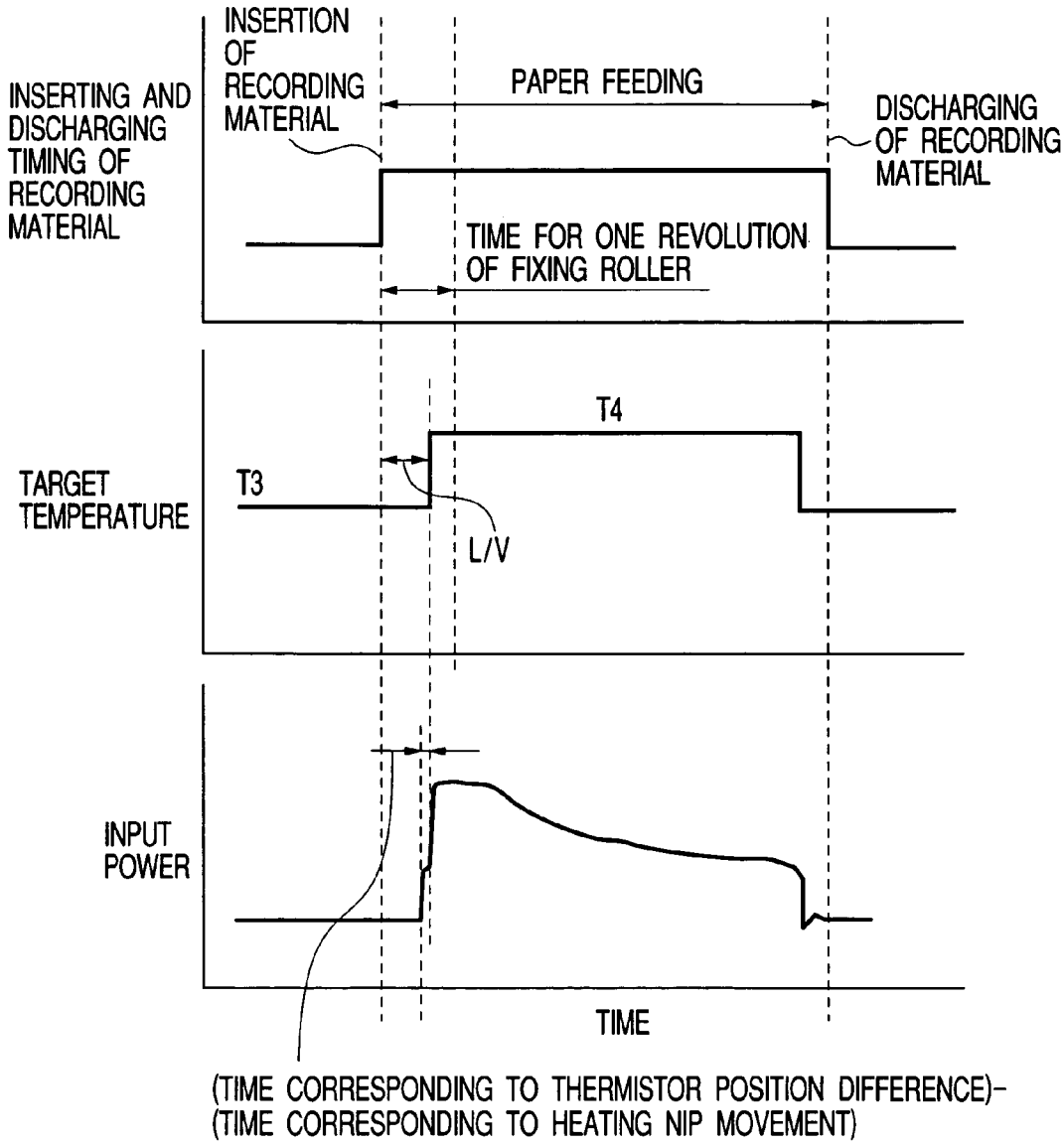
FIG. 8 is a diagram showing control according to Embodiment 2.
Figure 13:
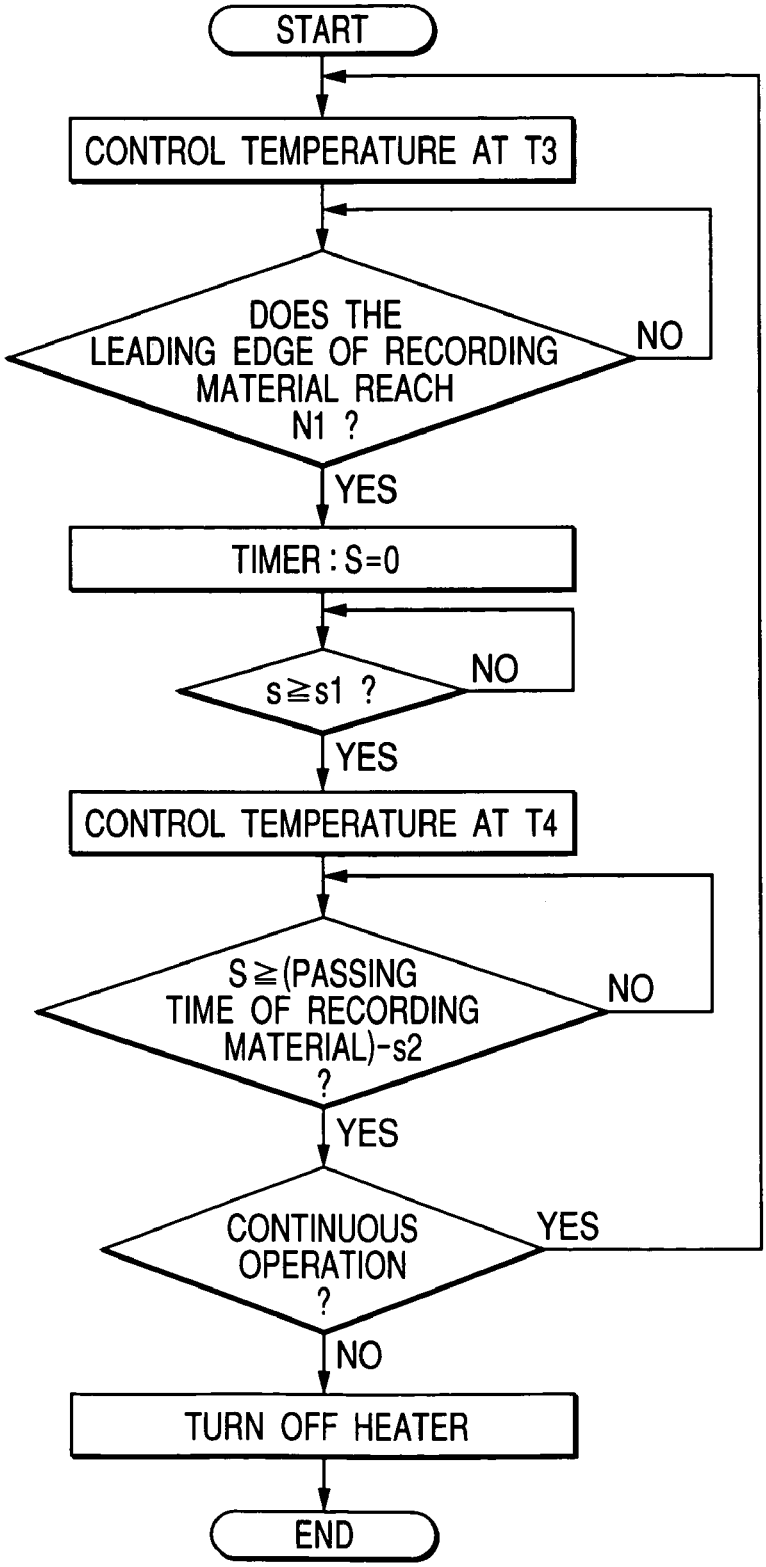
FIG. 13 is a diagram showing a control flow of an image forming apparatus according to Embodiment 2.

Embodiment 2; FIGS. 7, 8 and 13

FIG. 7 is a cross-sectional schematic diagram of the fixing apparatus 10 according to Embodiment 2. The fixing apparatus 10 of this embodiment and the fixing apparatus 10 shown above in FIG. 1 are compared with each other, and have the same structure except the positional difference of the thermistor 5 and the temperature control.

In the case of the fixing apparatus 10 of this embodiment, as shown in FIG. 7, a film guide surface shape is provided to the heater holder 2*c* so as to form a film extended contact portion C1 in which the heating film 2*a* contacts the surface of the fixing roller 1 additionally on an upstream side of the ceramic heater 2*b* (heating nip N2) in the surface-heating unit 2 in a fixing roller rotating direction. That is, the heating film 2*a* is guided by the heater holder 2*c*, and contacts the fixing roller 1 in the heating nip N2 and in the film extended contact portion C1 further upstream.

In addition, in the film extended contact portion C1 of the surface-heating unit 2, the thermistor 5 as the temperature detecting means is provided by being constantly abutted by a pressure spring or the like against a film surface of the heating film 2*a* opposite to the surface contacting the fixing roller 1, that is, a film inner surface (back surface) thereof.

According to a temperature detecting method using the above-described arrangement, a temperature decrease of the fixing roller 1 due to the paper passing is reflected on the detection temperature, so that the power supplied to the ceramic heater 2*b* is easy to get feedback from the deviation from the target temperature. Thus, the heat supplying capacity of the fixing roller 1 can be further maintained to be uniform.

FIG. 8 shows the control according to this embodiment over the elapse of time, and indicates the target temperature and the power that is inputted to the ceramic heater 2*b* with the insertion of the recording material P in the fixing nip N1 set as a starting point.

In this embodiment, the thermistor 5 detects the temperature decrease before the heating nip N2 is reached by a portion of the fixing roller 1 that contacts the leading edge of the recording material P. In accordance with the detection, the control circuit 100 increases the power supplied to the ceramic heater 2*b* to a certain degree.

FIG. 13 shows the control flow according to this embodiment. In this embodiment, at the time s1 when the heating nip N2 is reached by a portion of the fixing roller 1 that contacts the leading edge of the recording material P, the target temperature is switched from T3=190° C. to T4=220° C., thereby supplying a sufficient amount of heat to the fixing roller 1. Thus, the heat supplying capacity with respect to the recording material P can be maintained even in the second revolution or later.

Accordingly, similarly to Embodiment 1, the temperature of the recording material P after discharging can be maintained constant, and the decrease in gloss due to the revolution can be suppressed.

Figure 9:
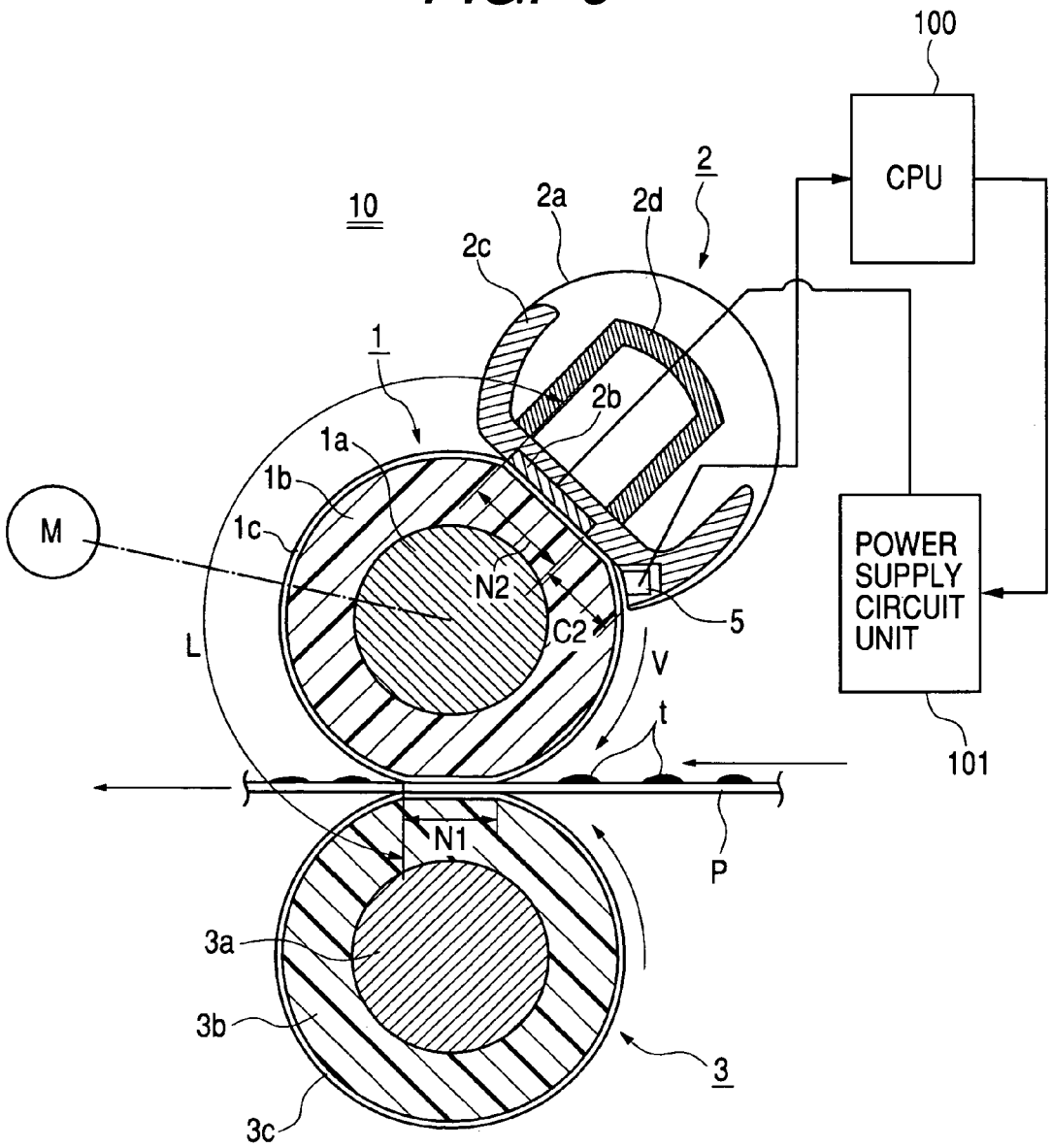
FIG. 9 is a cross-sectional schematic diagram of a fixing apparatus according to Embodiment 3.
Figure 10:
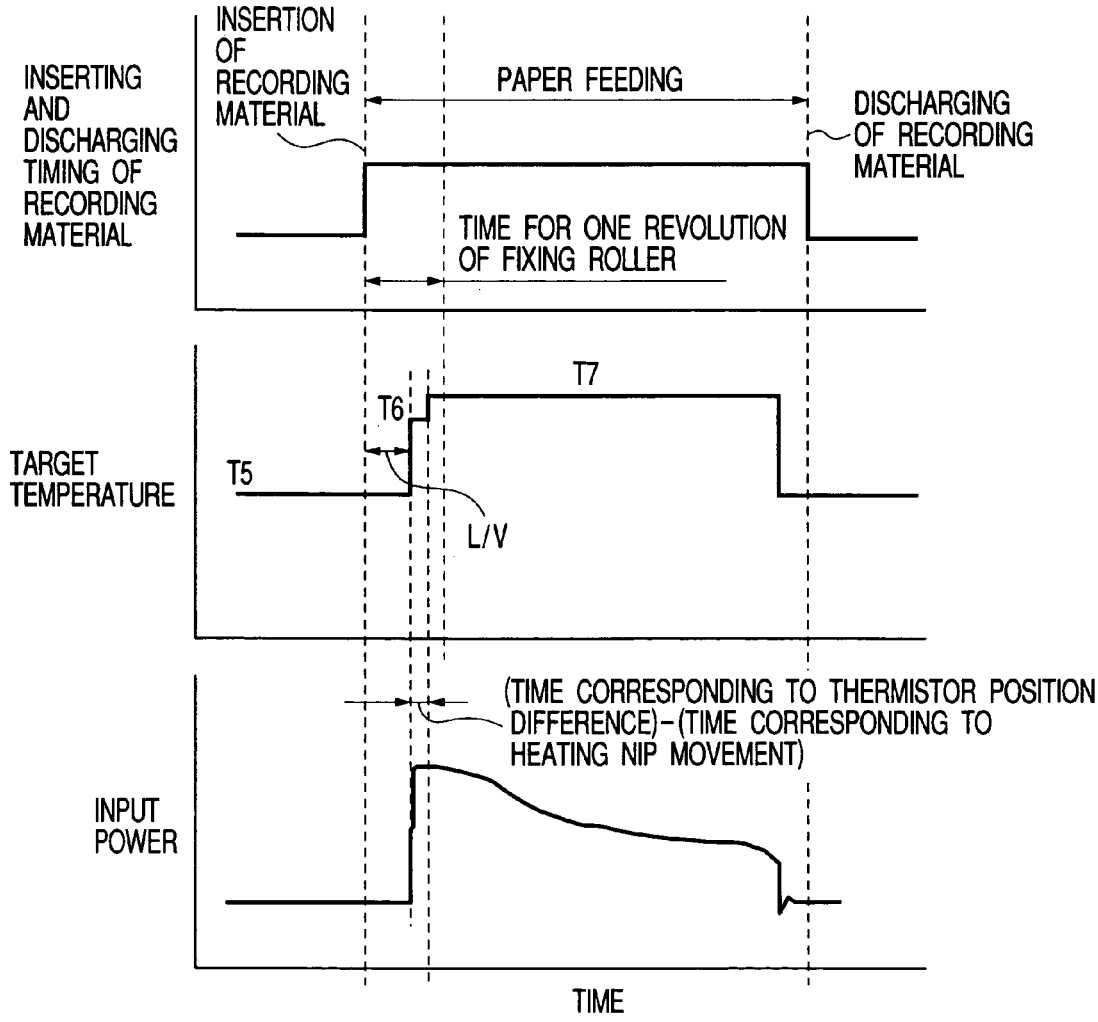
FIG. 10 is a diagram showing control according to Embodiment 3.
Figure 14:
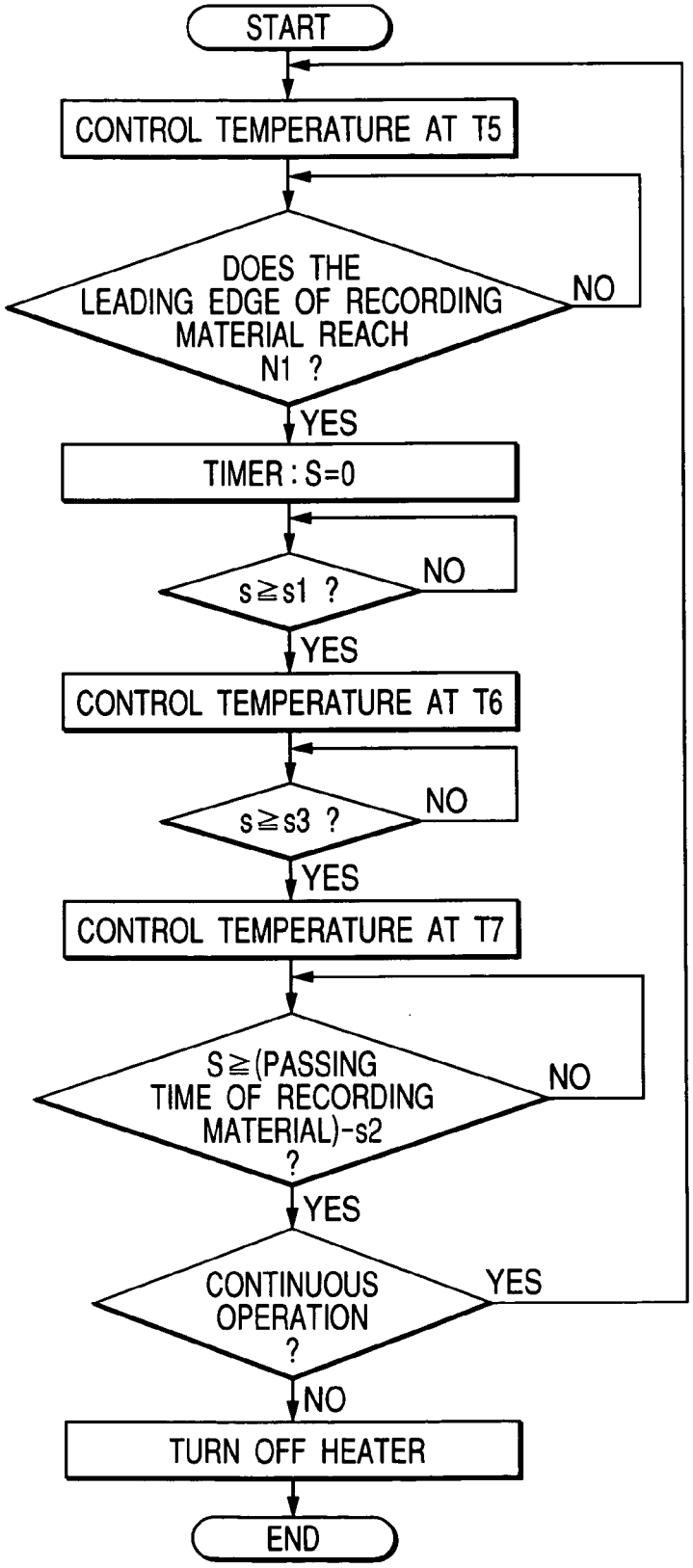
FIG. 14 is a diagram showing a control flow of an image forming apparatus according to Embodiment 3.

Embodiment 3; FIGS. 9, 10, and 14

FIG. 9 is a cross-sectional schematic diagram of the fixing apparatus 10 according to Embodiment 2. The fixing apparatus 10 of this embodiment and the above-described fixing apparatus 10 shown in FIG. 1 are compared with each other, and have the same structure except the positional difference of the thermistor 5 and the temperature control.

That is, the fixing apparatus 10 of this embodiment, the film guide surface shape is provided to the heater holder 2*c* so as to form a film extended contact portion C2 in which the heating film 2*a* contacts the surface of the fixing roller 1 on a downstream side of the ceramic heater 2*b* (heating nip N2) in the fixing roller rotating direction. The heating film 2*a* is guided by the heater holder 2*c*, and contacts the fixing roller 1 in the heating nip N2 and in the film extended contact portion C2 further downstream. In addition, in the film extended contact portion C2 of the surface-heating unit 2, the thermistor 5 as the temperature detecting means is provided by being constantly abutted by a pressure spring or the like against the film surface of the heating film 2*a* opposite to the surface contacting the fixing roller 1, that is, the film inner surface (back surface) thereof.

FIG. 14 shows the control flow according to this embodiment. In this embodiment, the thermistor is disposed on the downstream side of the ceramic heater 2*b* as the heating source in the film rotating direction, so that the thermistor 5 detects the heating state of the ceramic heater 2*b* with a high responsiveness. Accordingly, the stability (convergence) of the feedback control can be improved.

On the other hand, at the time s1 when the heating nip N2 is reached by the portion of the fixing roller 1 that contacts the leading edge of the recording material P, the thermistor 5 cannot detect its temperature decrease. At this timing, the target temperature is changed from T5=180° C. to T6=200° C. Note that the timing can be accurately predicted based on the time taken for the recording material P to reach the fixing apparatus 10 since the start of paper feeding. Further, at the time s3 when the thermistor 5 is reached by the portion of the fixing roller 1 that contacts the leading edge of the recording material P, the target temperature is changed to T7=230° C., thereby maintaining the heat supplying capacity of the fixing roller 1.

It is preferable to set T7 such that the temperature of the recording material P after discharging in the first revolution is the same as that in the second revolution or later. T6 is a temperature between T5 and T7, and is set such that the power supply is rapidly performed with the target temperature difference between T5 and T6 in consideration of the rising time due to the PID control.

FIG. 10 shows the control according to this embodiment over the elapse of time, and indicates the target temperature and the power that is inputted to the ceramic heater 2*b* with the insertion of the recording material P in the fixing nip N1 set as a starting point.

According to the above temperature control, the surface temperature of the fixing roller 1 in the second revolution or later is increased, so that the heat supplying capacity with respect to the recording material P in the first revolution and the second revolution or later can be made uniform. Accordingly, image non-uniformity such as uneven gloss can be eliminated.

<Others> a) The fixing roller 1 as the rotary member for heating is not limited to the roller member, but a pivoting belt member can be used instead.

b) The surface-heating unit 2 as the heating source is not limited to the ceramic heater 2*b*. For example, a positive temperature coefficient (PTC) heater, a heat generating member of an electromagnetic induction, or the like can also be used. Also, as the ceramic heater 2*b*, a metal plate whose surface has been insulated can be used instead of a ceramic insulating substrate.

As the heating film 2*a*, a film made of metal can also be used. In addition, by forming the film made of metal itself as the heat generating member of an electromagnetic induction, the structure for generating heat by exciting means can be obtained.

As the surface-heating unit 2, a heating member of a non-contact type such as an infrared lamp device can also be used.

c) As to the pressure roller 3 as a pressing rotary member according to Embodiments 1 to 3, a pressure film unit composed of an endless belt and a pressure member, which is disclosed in JP 2001-228731 A, may be used instead of the pressure roller to achieve a smaller heat capacity.

d) The heating apparatus according to the present invention is not limited to an image heating and fixing apparatus according to the above-described embodiments, but may be widely used as means or an apparatus for heating a heating material such as: an image heating apparatus for heating a recording material bearing an image to reform surface properties including gloss, an image heating apparatus for temporary fixing, a heating and drying apparatus for a heating material, and a heat laminating apparatus.

Hereinabove, description has been made of the present invention by showing various examples and embodiments. However, it can be understood by one skilled in the art that the gist and the scope of the present invention are not limited to the specific descriptions and drawings in this specification, but include all various modifications and variations described in the scope of the claims appended hereto. Examples of aspects of the present invention are listed hereinbelow.

What is claimed is:

1. An image forming apparatus, comprising:

an image forming part for forming an unfixed toner image on a recording material;

a fixing part including a first rotary member and a second rotary member that are in contact with each other to form a nip and a heating member for heating said first rotary member in a heating position different from the nip, and for fixing an unfixed image formed on a recording material to the recording material in the nip using heat of said first rotary member, said heating member including a film and heating a surface of said first rotary member through said film;

a temperature detector for detecting temperature of said film of said heating member at an upstream side of a heating portion of said film; and a power control part for controlling power to be supplied to said heating member so as to increase an amount of heat supplied to said first rotary member substantially at a timing when a portion of said first rotary member contacts a leading edge of the recording material in the nip reaches the heating position based on the temperature detected by said temperature detector.

2. An image forming apparatus according to claim 1, wherein substantially at a timing when the position of said heating member reaches a portion of said first rotary member contacts a trailing edge of the recording material in the nip, said power control part controls the power to be supplied to said heating member so as to decrease the amount of heat supplied to said first rotary member.

3. An image forming apparatus according to claim 1, wherein said heating member comprises a ceramic heater.

4. An image forming apparatus according to claim 1, wherein the image forming apparatus is a color image forming apparatus for forming an image having a plurality of color components onto the recording material.

* * * * *